US006960075B2

(12) United States Patent
Rajewski

(10) Patent No.: US 6,960,075 B2
(45) Date of Patent: Nov. 1, 2005

(54) FLARE STACK OPERATING ON COANDA PRINCIPLE

(76) Inventor: Robert C. Rajewski, R.R. #1, Donalda, Alberta (CA), T0B 1H0

( * ) Notice: Subject to any disclaimer, the term of this patent is extended or adjusted under 35 U.S.C. 154(b) by 0 days.

(21) Appl. No.: 10/314,424

(22) Filed: Dec. 9, 2002

(65) Prior Publication Data

US 2004/0110105 A1 Jun. 10, 2004

(51) Int. Cl.[7] ..... F23D 11/00
(52) U.S. Cl. ..... 431/202; 431/354; 239/DIG. 7
(58) Field of Search ..... 431/202, 354; 239/505, 506, DIG. 7

(56) References Cited

U.S. PATENT DOCUMENTS

| | | | | |
|---|---|---|---|---|
| 1,168,395 A | | 10/1916 | Meyers | 431/285 |
| 3,554,681 A | | 1/1971 | Proctor | 431/202 |
| 3,794,137 A | | 2/1974 | Teodorescu et al. | 181/33 E |
| 3,833,337 A | | 9/1974 | Desty et al. | 431/284 |
| 3,840,320 A | | 10/1974 | Desty et al. | 431/4 |
| 3,914,093 A | | 10/1975 | Proctor | 431/89 |
| 3,915,622 A | | 10/1975 | Desty et al. | 431/284 |
| 3,995,986 A | | 12/1976 | Straitz, III | 431/202 |
| 4,021,189 A | | 5/1977 | Swann et al. | 431/202 |
| 4,099,908 A | | 7/1978 | Beckmann et al. | 431/284 |
| 4,147,493 A | | 4/1979 | Straitz, III | 431/15 |
| 4,336,017 A | | 6/1982 | Desty | 431/202 |
| 4,344,751 A | | 8/1982 | Chesters | 431/202 |
| 4,464,110 A | | 8/1984 | Boden et al. | 431/202 |
| 4,486,167 A | | 12/1984 | McMurray et al. | 431/114 |
| 4,634,370 A | | 1/1987 | Chesters | 431/202 |
| 4,634,372 A | * | 1/1987 | Allum et al. | 431/202 |
| 4,643,669 A | | 2/1987 | Bozai | 431/202 |
| 4,854,855 A | | 8/1989 | Rajewski | 431/202 |
| 5,658,141 A | * | 8/1997 | Larquet et al. | 431/187 |
| 5,908,292 A | * | 6/1999 | Smith et al. | 432/197 |
| 5,975,885 A | * | 11/1999 | Rajewski | 431/89 |

FOREIGN PATENT DOCUMENTS

| | | |
|---|---|---|
| GB | 1 604 441 | * 12/1981 |

* cited by examiner

*Primary Examiner*—Alfred Basichas

(57) ABSTRACT

A flare stack operating on the Coanda principle in which provision is made for cooling of a Coanda body terminating the gas flue by a flow of cooling fluid within the Coanda body. The pressure in the flare stack is held constant by a mechanism disposed outside of the main flue of the flare stack.

8 Claims, 7 Drawing Sheets

FLARE STACK OPERATING ON COANDA PRINCIPLE

BACKGROUND OF THE INVENTION

This invention relates to gas flares that operate on the Coanda principle. An exemplary such gas flare is shown in U.S. Pat. No. 4,634,372 issued Jan. 6, 1987. In such gas flares, a Coanda body is positioned across a flare stack to form an annular slot between the Coanda body and the pipe forming the gas conduit for the flare stack. The slot height is variable by use of springs within the flare stack to maintain a constant pressure in the flare stack. Such conventional flare stacks are subject to damage when a flame stabilizes on the surface of the Coanda body, and the springs are subject to damage and fouling by virtue of being exposed continuously to the corrosive and contaminated gases of the flare gas.

SUMMARY OF THE INVENTION

This invention, in its various independent aspects, provides an improved flare stack. In a first aspect of the invention, provision is made for cooling of a Coanda body terminating a flare stack by a flow of cooling fluid within the Coanda body. In a second aspect of the invention, the pressure in the flare stack is held constant by a mechanism disposed outside of the main flue of the flare stack. When pressure is low, the gas flue is closed, thus eliminating the need for purging of the flare stack.

These and other aspects of the invention are described in the detailed description of the invention and claimed in the claims that follow.

BRIEF DESCRIPTION OF THE DRAWINGS

There will now be described preferred embodiments of the invention, with reference to the drawings, by way of illustration only and not with the intention of limiting the scope of the invention, in which like numerals denote like elements and in which.

DETAILED DESCRIPTION OF PREFERRED EMBODIMENTS

In this patent document, the word "comprising" is used in its non-limiting sense to mean that items following the word in the sentence are included and that items not specifically mentioned are not excluded. The use of the indefinite article "a" in the claims before an element means that one of the elements is specified, but does not specifically exclude others of the elements being present, unless, unless the context clearly requires that there be one and only one of the elements.

Figure 1A:
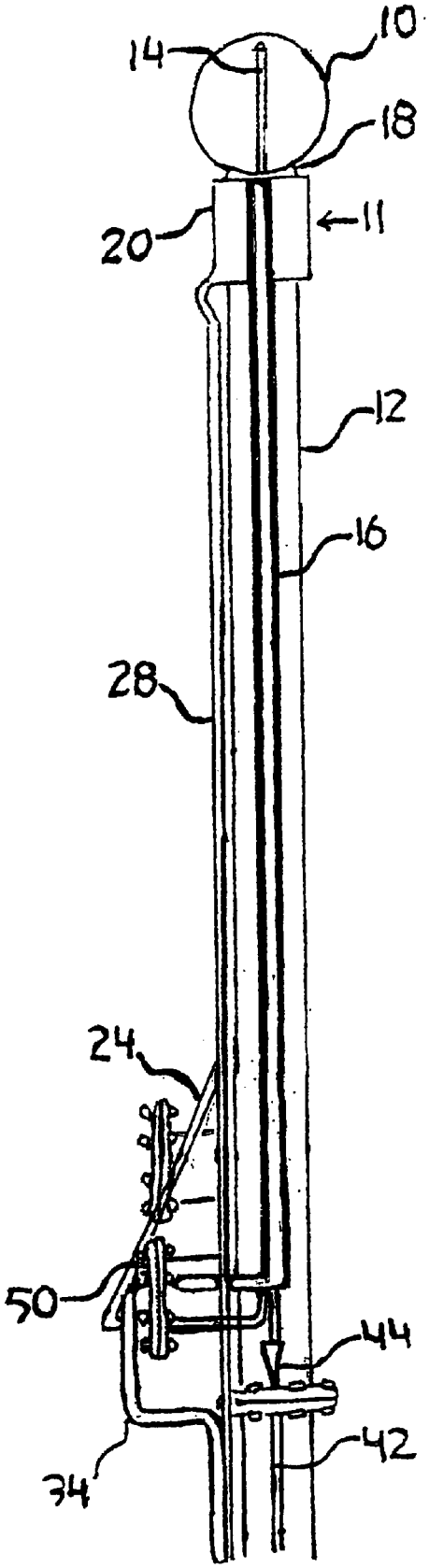
FIGS. 1A and 1B together show a Coanda flare stack according to the invention.
Figure 2:
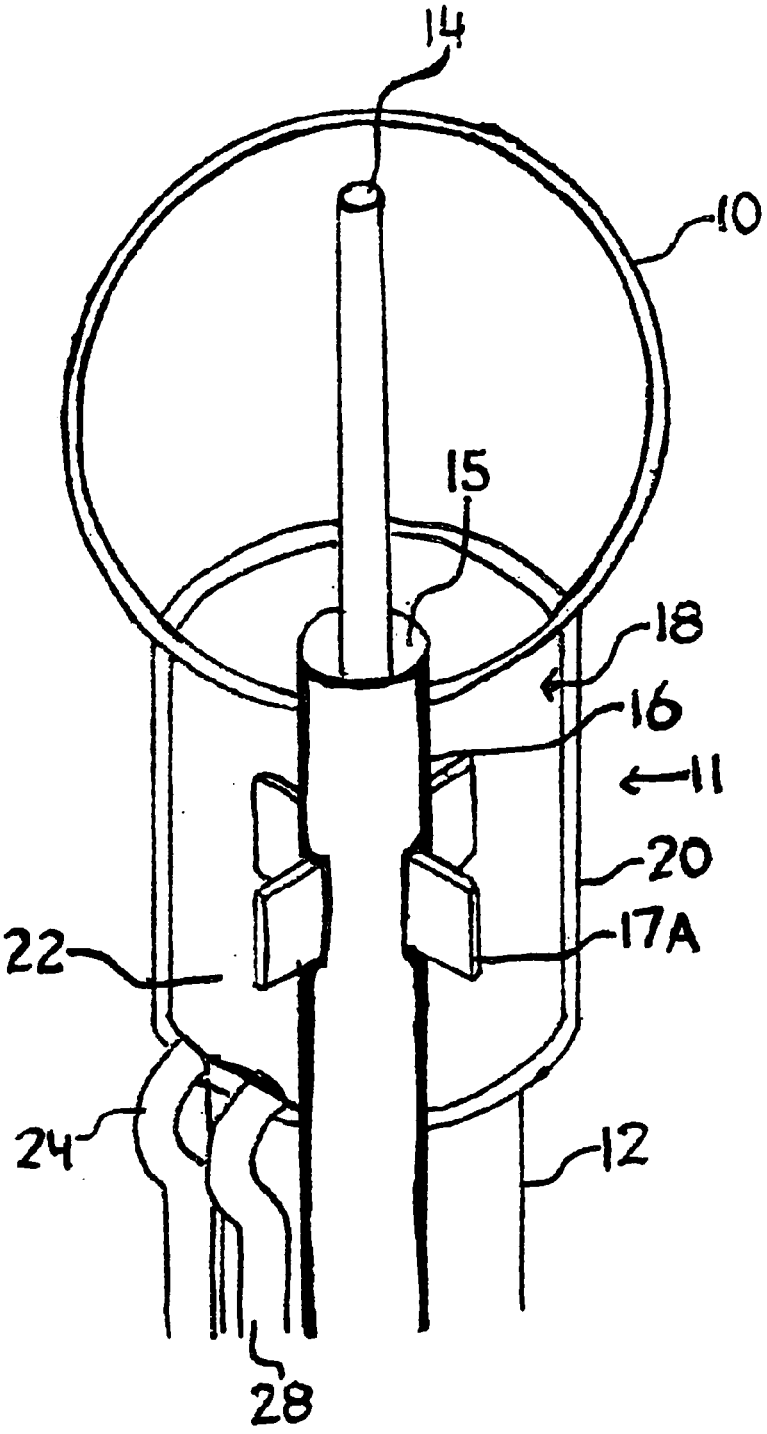
FIG. 2 is a perspective view of the top end of a fluid circulation system for use with the Coanda flare stack of FIGS. 1A and 1B.

Referring to FIGS. 1A and 2, there is shown a flare stack of the Coanda type, which has a Coanda body 10 disposed adjacent the flare end 11 of a gas flue 12. Gas flue 12 receives gas from, for example an oil-gas separator, through pipe 13. The shape of the Coanda body 10, and its design, as well as the gas flue 12, otherwise than as indicated in this patent document is conventional. The Coanda body 10 is supported by a cooling fluid circuit that includes a cooling fluid supply conduit 16 and a cooling fluid removal conduit 14. The cooling fluid removal conduit 14 is disposed concentrically within the cooling fluid supply conduit 16 to form an annular gap 15 through which cooling fluid enters the Coanda body 10. The cooling fluid supply conduit 16 is located centrally within the gas flue 12 by upper vanes 17A and lower vanes 17B acting as spacers and is connected at its lower end to a tensioning cable 19. The supply conduit 16 is free to move up and down within the gas flue 12 and is secured as by welding to the spherical Coanda body 10.

As part of the cooling fluid circuit, a cylindrical jacket 20 surrounds the flare end 11 of the gas flue 12. The cylindrical jacket 20 forms an annular volume at the flare end 11 of the gas flue that is divided by a barrier 22. A tip coolant supply line 24 is connected to the coolant fluid return line 14 and delivers coolant to the jacket 20 on one side of the barrier 22. The coolant flows around the annular volume defined by the jacket 20 and the flare end 11 and returns to heat exchanger 26 at the base of the gas flue 12 through tip coolant return line 28.

Figure 1B:
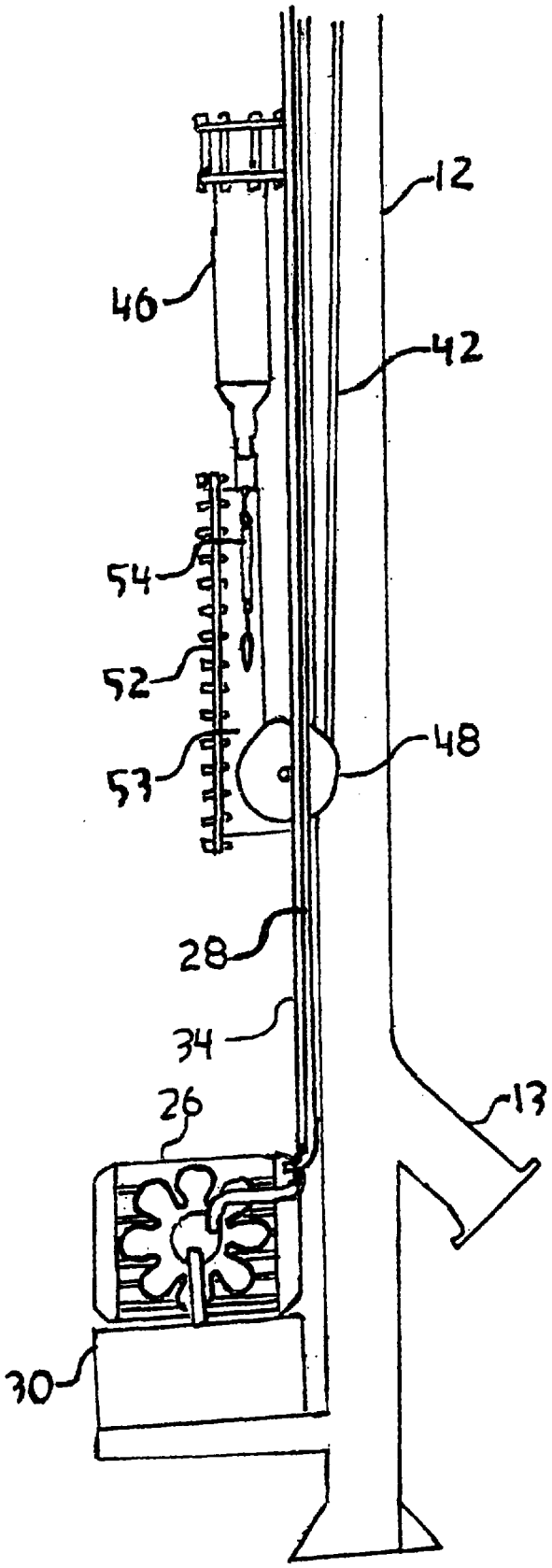
Figure 5:
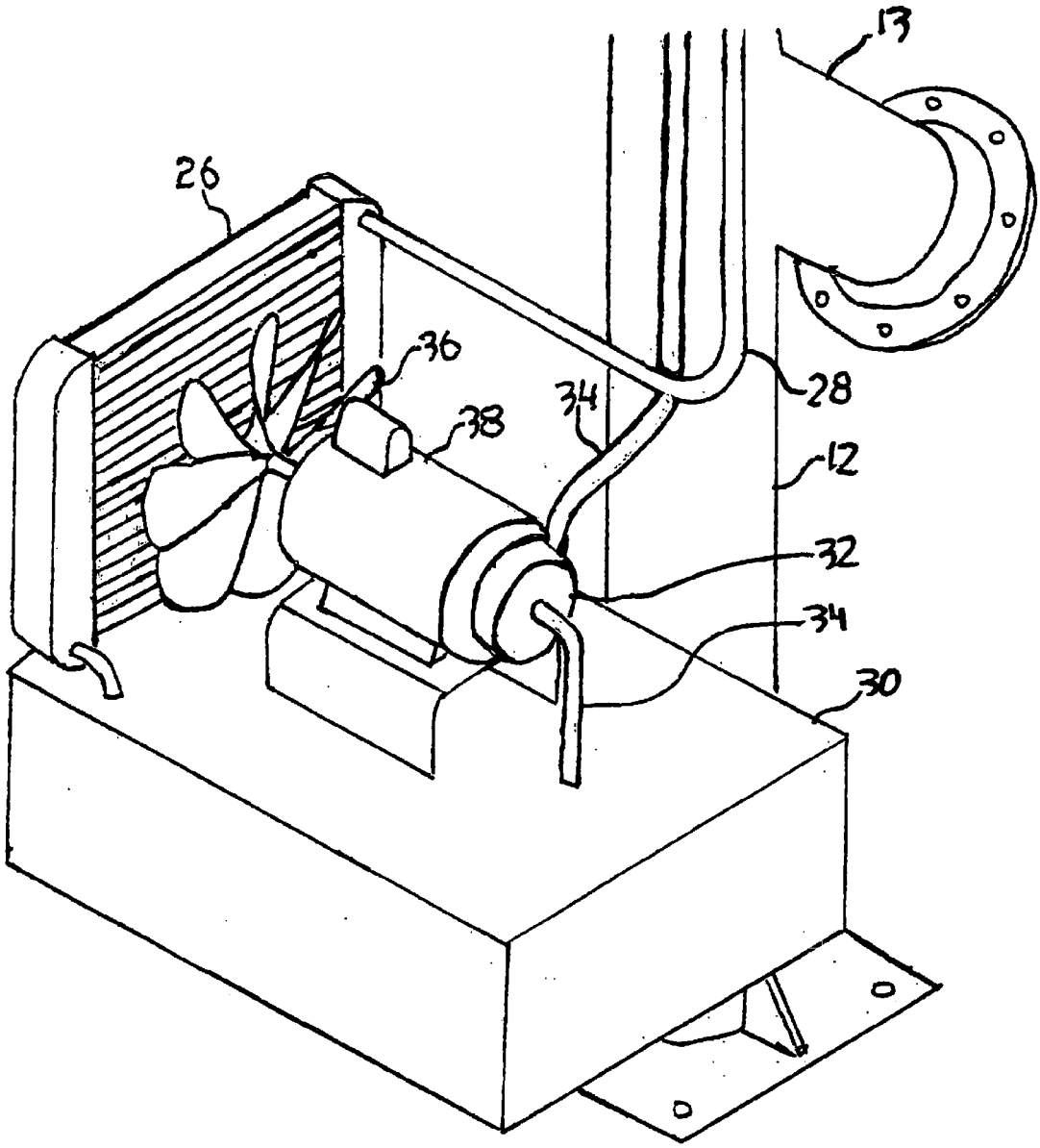
FIG. 5 shows a heat exchanger and pump for the fluid circulation system.

The Coanda body 10 responds to gas pressure in the gas flue 12 by lifting off the flare end 11 to form an adjustable annular gap 18 between the Coanda body 10 and the flare end 11 of the gas flue 12. Gas emitted frown the flare end 11 passes through the adjustable annular gap 18 and around the Coanda body 10. The Coanda body 10 is fluid cooled by the cooling fluid circuit. As shown in FIGS. 1B and 5, the cooling fluid circuit includes heat exchanger 26, fluid reservoir 30, and pump 32. Fluid is pumped into the supply conduit 16 along line 34 from reservoir 30 using pump 32 operated by electric motor 38. The electric motor 38 also operates a fan 40 that blows air through the heat exchanger 26 to cool fluid flowing in the heat exchanger 26. Heated fluid returned from the Coanda body 10 flows through return conduit 14, tip coolant supply line 24, jacket 20, and tip coolant return line 28 to fluid heat exchanger 26 and from there to reservoir 30. The reservoir 30 may be controllably heated as required to prevent freeze up in cold conditions.

Figure 3:
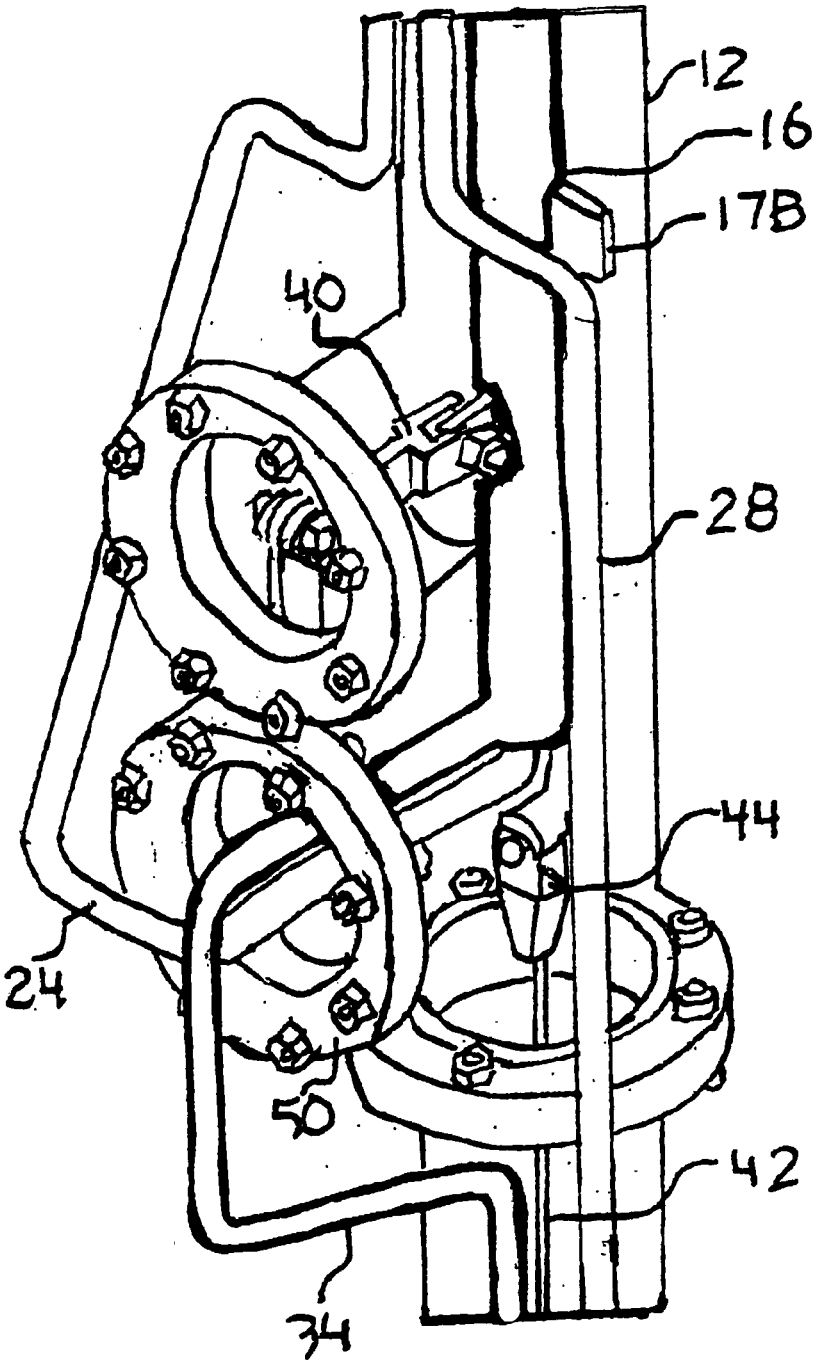
FIG. 3 is a perspective view showing how conduits in the fluid circulation system of FIG. 2 enter and exit the flare stack of FIGS. 1A and 1B.
Figure 4A:
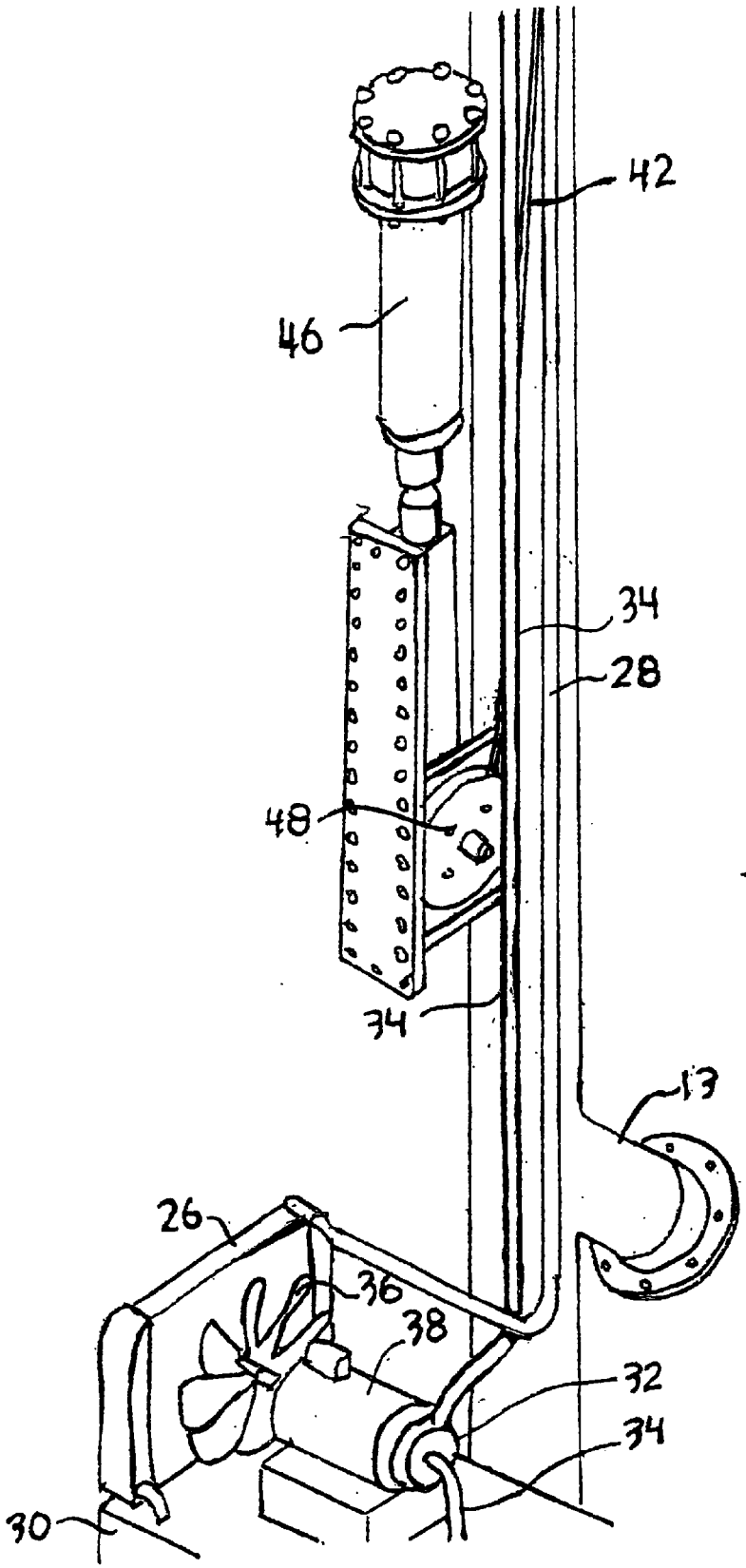
FIG. 4A is a perspective view of a first tensioning device for placing tension on the Coanda body shown in FIG. 1A.
Figure 4B:
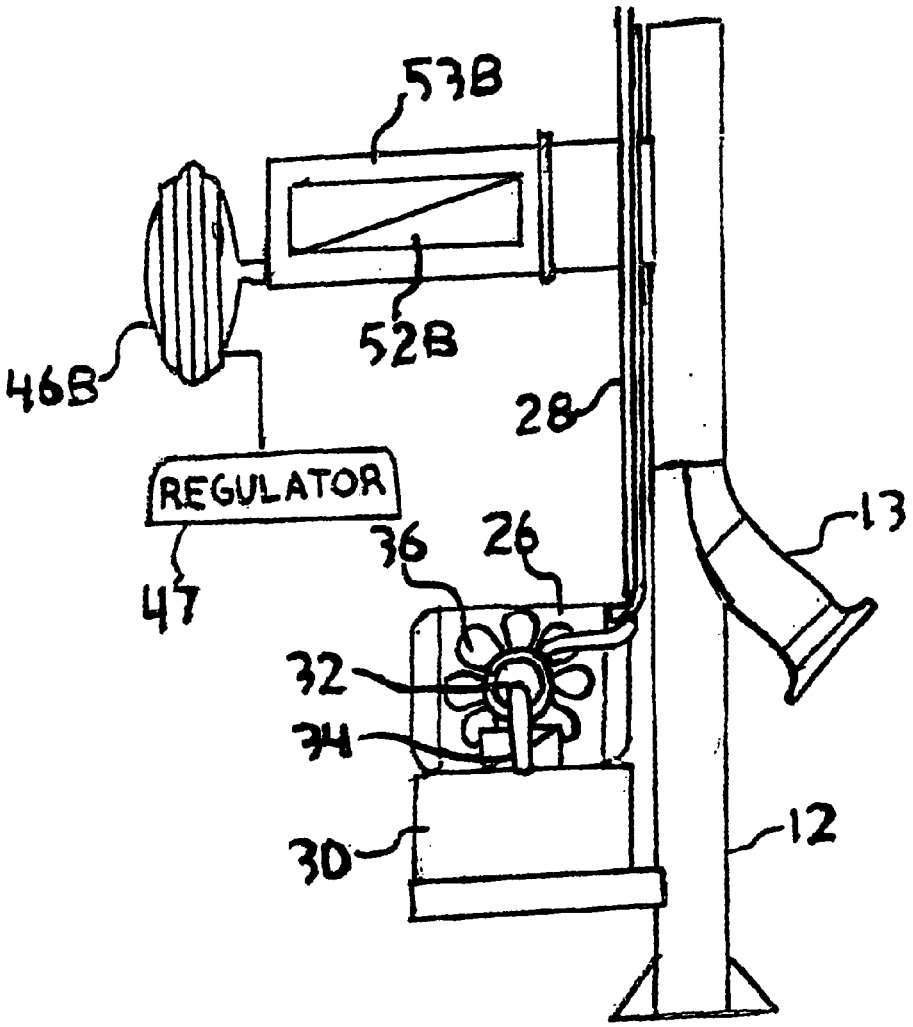
FIG. 4B is a perspective view of a second tensioning device for placing tension on the Coanda body shown in FIG. 1A.

Referring to FIGS. 3, 4A and 4B, the Coanda body 10 is supported on a pivot arm 40 that is pivotally linked to both the conduit 16 and the gas flue 12. To maintain a constant gas pressure in the gas flue, a cable 42 is secured through a connector 44 to the lower end of the conduit 16 and to a tensioning device 46. The cable 42 runs out of the gas flue around a pulley 48. The tensioning device 46 does not have to be connected to the Coanda body 10 through the conduits 14 or 16, but it is convenient to do so. In the example shown in FIG. 3, the Coanda body 10 and tensioning device 46 are connected through the supply conduit 16. The return conduit 14 is fixed to the supply conduit 16 and to the Coanda body 10 as shown in FIGS. 1A and 3, but in this embodiment is not connected directly to the tensioning device 46. As shown in FIG. 3, the return conduit 14 connects to conduit 24 and exits the gas flue 12 removable cover 50. The length of the cable 42 may be adjusted by opening removable cover 52 on housing 53 and adjusting the cable 42 with conventional cable adjustor 54.

The tensioning device 46 may be a single acting cylinder that is kept pressurized at a constant pressure (FIG. 4A) or may be a diaphragm type device 46B (FIG. 4B) attached to cable 42 and similarly kept pressurized at constant pressure. Constant pressure on the tensioning device 46, 46B may be obtained using a conventional pressure regulator 47 (FIG. 4B). The pressure may be set for example to 50 psi, and is preferably kept above 10 psi. The pressure setting on the tensioning device 46, 46B is then essentially the same as the maintained pressure at the tip of the gas flue 12. The cable 42 in FIG. 4B is attached at one end to the diaphragm of the tensioning device 46B and passes through gas tight housing 53B, which is provided with a removable cover 52B for access to a cable adjustor (not shown, but same as cable adjustor 54), around a pulley (not shown, but same as pulley 48) and through the gas flue 12 to connector 44. The constant pressure on the piston or diaphragm opposes gas pressure in the gas flue 12 and tends to pull the Coanda body onto the flare tip 11. Maintaining a constant pressure in the tensioning device 46 maintains a constant back pressure on gas in the gas flue 12. When the gas pressure in the gas flue 12 falls below the constant gas pressure, the tensioning device 46 closes the gap 18, and thus raises the pressure in the gas flue.

When pressure in the gas flue is low, the gap 18 is reduced to zero and the gas flue 12 is closed. As pressure builds up in the gas flue 12, the Coanda body 10 is lifted off the gas flue 12, thus releasing gas from the gas flue 12. Closing of the gap 18 at low gas flue pressure eliminates the need to add gas continuously to the gas flue to purge it of any air.

A person skilled in the art could make immaterial modifications to the invention described in this patent document without departing from the essence of the invention that is intended to be covered by the scope of the claims that follow.

I claim:

1. A Coanda flare, comprising:

a gas flue having a flare end;

a Coanda body disposed adjacent the flare end to form an adjustable annular gap between the Coanda body and the flare end of the gas flue, such that gas emitted from the flare end passes through the annular gap and around the Coanda body; and the Coanda body being fluid cooled by a cooling fluid circuit.

2. A Coanda flare, comprising:

a gas flue having a flare end;

a Coanda body disposed adjacent the flare end to form an adjustable annular gap between the Coanda body and the flare end of the gas flue, such that gas emitted from the flare end passes through the adjustable annular gap and around the Coanda body; and the Coanda body being fluid cooled by a cooling fluid supply conduit leading into the Coanda body for supply of cooling fluid to the Coanda body and a cooling fluid return conduit leading out from the Coanda body for return of cooling fluid from the Coanda body.

3. The Coanda flare of claim 2 in which the Coanda body is held in position against pressure in the gas flue by a tensioning device.

4. The Coanda flare of claim 3 in which the tensioning device maintains a constant back pressure on the gas in the gas flue.

5. A Coanda flare, comprising:

a gas flue having a flare end;

a Coanda body disposed adjacent the flare end to form an adjustable annular gap between the Coanda body and the flare end of the gas flue, such that gas emitted from the flare end passes through the adjustable annular gap and around the Coanda body;

the Coanda body being fluid cooled by a cooling fluid circuit having a cooling fluid supply conduit leading into the Coanda body for supply of cooling fluid to the Coanda body and a cooling fluid removal conduit leading out from the Coanda body for removal of cooling fluid from the Coanda body;

the cooling fluid supply conduit and the cooling fluid removal conduit being connected to the gas flue by a joint that permits relative movement of the combination of Coanda body and cooling fluid circuit in relation to the gas flue; and a tensioning device connected to the joint to provide constant back pressure on the gas in the gas flue.

6. The Coanda flare of claim 5 in which the Coanda body is supported by the cooling fluid circuit.

7. A flare, comprising:

a gas flue having a flare end;

a gas supply conduit communicating with the flare end for the supply of gas to be flared;

a cooling fluid circuit having a segment surrounding the flare end of the gas flue;

the cooling fluid circuit having a cooling fluid supply line leading from a cooling fluid reservoir to the segment of the cooling fluid circuit surrounding the flare end of the gas flue;

the cooling fluid circuit having a cooling fluid return line leading away from the segment of the cooling fluid circuit surrounding the flare end of the gas flue; and a heat exchanger on the cooling fluid circuit.

8. The flare of claim 7 in which the cooling fluid circuit further comprises:

a pump for moving cooling fluid through the fluid cooling circuit; and a fan disposed adjacent to the heat exchanger for blowing air through the heat exchanger to cool cooling fluid moving through the heat exchanger.

* * * * *